US009422756B2

(12) United States Patent
Bacchetti

(10) Patent No.: US 9,422,756 B2
(45) Date of Patent: Aug. 23, 2016

(54) CONCEALABLE HINGE FOR THE CONTROLLED ROTATABLE MOVEMENT OF A DOOR, IN PARTICULAR A REINFORCED DOOR

(71) Applicant: Luciano Bacchetti, Via Della Fonte (IT)

(72) Inventor: Luciano Bacchetti, Via Della Fonte (IT)

(73) Assignee: IN & TEC S. R. L., Brescia (IT)

( * ) Notice: Subject to any disclaimer, the term of this patent is extended or adjusted under 35 U.S.C. 154(b) by 0 days.

(21) Appl. No.: 14/880,255

(22) Filed: Oct. 11, 2015

(65) Prior Publication Data

US 2016/0060930 A1 Mar. 3, 2016

Related U.S. Application Data

(63) Continuation of application No. PCT/IB2014/060661, filed on Apr. 11, 2014.

(51) Int. Cl.
*E05D 11/00* (2006.01)
*E05D 5/06* (2006.01)
(Continued)

(52) U.S. Cl.
CPC ..... *E05D 11/0054* (2013.01); *E05D 5/06* (2013.01); *E05D 5/121* (2013.01); *E05D 7/04* (2013.01);
(Continued)

(58) Field of Classification Search
CPC ..... E05D 11/0054; E05D 7/06; E05D 11/00; E05D 5/06; E05D 11/06; E05D 5/121; E05D 7/0423; E05D 7/04; E05D 11/105; E05D 2007/0492; E05F 5/02; E05F 5/08; Y10T 16/53225; Y10T 16/5323; Y10T 16/53235; Y10T 16/53238; Y10T 16/53253; Y10T 16/533; Y10T 16/54021; Y10T 16/625; Y10T 16/628; Y10T 16/6285; Y10T 16/558; Y10T 16/5525; Y10T 16/554; Y10T 16/54028; E05Y 2800/678; E05Y 2600/502; E05Y 2600/41; E05Y 2201/628; E05Y 2201/638
USPC ..... 16/250, 322, 85, 86 R, 86 A, 238–241, 16/245, 387, 379, 382, 334; 49/398
See application file for complete search history.

(56) References Cited

U.S. PATENT DOCUMENTS 5,075,928 A * 12/1991 Bobrowski ..... E05D 5/06 16/273

(Continued)

FOREIGN PATENT DOCUMENTS

| | | |
|---|---|---|
| DE | 2035597 | 2/1971 |
| EP | 0220579 | 5/1987 |

(Continued)

*Primary Examiner* — William Miller
(74) *Attorney, Agent, or Firm* — Mark David Torche; Patwrite LLC

(57) ABSTRACT

An Anuba concealed hinge for rotatable moving a door, in particular a reinforced door, connected to a tubular support structure, which includes a rear counterframe anchored to a wall and a front frame anchored to the counterframe The hinge includes a lower fixed half-hinge and an upper movable half-hinge rotatably coupled to each other for rotating about a first longitudinal axis between an open position and a closed position. The lower fixed half-hinge includes a box-shaped hinge body to be concealedly inserted within the tubular support structure. The upper movable half-hinge includes a connecting plate connected to the door to extend from the tubular support structure in the open position and to concealedly retract within the tubular support structure in the closed position. The movable half-hinge includes a pivot defining the first axis unitarily connected to the connecting plate. The hinge body (11) includes a seat internally housing the pivot.

18 Claims, 12 Drawing Sheets

(51) Int. Cl.

| | |
|---|---|
| ***E05D 5/12*** | (2006.01) |
| ***E05D 7/04*** | (2006.01) |
| ***E05D 11/06*** | (2006.01) |
| ***E05D 11/10*** | (2006.01) |
| ***E05D 7/06*** | (2006.01) |
| ***E05F 5/02*** | (2006.01) |
| ***E05F 5/08*** | (2006.01) |

(52) U.S. Cl.

CPC ..... *E05D 7/0423* (2013.01); *E05D 7/06* (2013.01); *E05D 11/00* (2013.01); *E05D 11/06* (2013.01); *E05D 11/105* (2013.01); *E05F 5/02* (2013.01); *E05F 5/08* (2013.01); *E05D 2007/0492* (2013.01); *E05Y 2201/628* (2013.01); *E05Y 2201/638* (2013.01); *E05Y 2600/41* (2013.01); *E05Y 2600/502* (2013.01); *E05Y 2800/678* (2013.01); *Y10T 16/54028* (2015.01)

(56) References Cited

U.S. PATENT DOCUMENTS

| | | | | |
|---|---|---|---|---|
| 5,799,370 | A * | 9/1998 | Davidian | E05D 7/0415 16/236 |
| 6,487,755 | B1 * | 12/2002 | Caldari | E05D 3/186 16/287 |
| 8,196,265 | B2 * | 6/2012 | Neukoetter | E05D 3/186 16/236 |
| 8,234,753 | B2 * | 8/2012 | Cook | E05D 5/02 16/262 |
| 8,413,299 | B2 * | 4/2013 | Bartels | E05D 7/0423 16/236 |
| 8,621,717 | B2 * | 1/2014 | Liermann | E05D 3/186 16/364 |
| 8,850,661 | B2 * | 10/2014 | Liermann | E05D 3/186 16/357 |
| 8,863,361 | B2 * | 10/2014 | Neukoetter | E05D 3/186 16/366 |
| 2002/0023314 | A1 * | 2/2002 | Goldsmith | E05D 3/186 16/372 |
| 2003/0088943 | A1 * | 5/2003 | Neukotter | E05D 3/186 16/366 |
| 2013/0067686 | A1 * | 3/2013 | Migliorini | E05D 3/16 16/298 |
| 2016/0060937 | A1 * | 3/2016 | Bacchetti | E05F 5/08 16/322 |

FOREIGN PATENT DOCUMENTS

| | | | | |
|---|---|---|---|---|
| FR | 1586435 | | 2/1970 | |
| GB | 2484527 | | 4/2012 | |
| IT | WO 2014006587 | A1 * | 1/2014 | E05D 5/06 |

* cited by examiner

CONCEALABLE HINGE FOR THE CONTROLLED ROTATABLE MOVEMENT OF A DOOR, IN PARTICULAR A REINFORCED DOOR

FIELD OF INVENTION

The present invention is generally applicable to the technical field of the closing or damping/control hinges, and particularly relates to a hinge for the controlled rotatable movement of a door, in particular but not exclusively a reinforced door.

BACKGROUND OF THE INVENTION

As known, the closing or damping hinges generally comprise a movable element, usually fixed to a door, a shutter or the like, which movable element is pivoted on a fixed element, usually fixed to a support frame, or to a wall and/or the floor.

More particularly, in the case of concealed hinges for reinforced doors or the like, the fixed element of the hinge is inserted into a support structure that includes a rear tubular counterframe anchored to a wall or like support and a front frame anchored to the counterframe.

On the other hand, the movable element generally includes a connecting plate to be fixed to the door intended to come out from the tubular support structure in the open position and to retract completely within the tubular support structure in the closed position.

Generally, such hinges are purely mechanical, and not allow any kind of adjustment of the opening angle of the door or anyway no control of the movement of the door.

Examples of such known hinges are shown in the documents U.S. Pat. No. 5,075,928 and WO2010049860.

The absence of control makes such hinges extremely dangerous, since due to the great weight of the reinforced door there is the danger of unhinging of the door or the inflection of the tubular support structure to which the hinge is anchored.

Similarly, due to the great weight of the door, the hinge tends to lose the initial position and/or to misalign.

Moreover, the adjustment of the position of the door is difficult and complicated. Furtherly, to do this operation at least two operators are needed.

Another recognized drawback of these hinges is in the high frictions between fixed and movable element, which leads to frequent wear and breakage, with consequent need for continuing maintenance.

SUMMARY OF THE INVENTION

An object of the present invention is to overcome at least partly the above mentioned drawbacks, by providing a hinge having high performances, simple construction and low cost.

Another object of the invention is to provide a hinge which allows controlling the movement of the door upon its opening and/or its closing.

Another object of the invention is to provide a strong and reliable hinge.

Another object of the invention is to provide a hinge having extremely small dimensions.

Another object of the invention is to provide a hinge suitable for supporting very heavy doors and shutters.

Another object of the invention is to provide a hinge that has a minimum number of constituent parts.

Another object of the invention is to provide a hinge suitable to maintain the exact closing position during time.

Another object of the invention is to provide a hinge that is safe.

Another object of the invention is to provide a hinge that is easy to install.

Another object of the invention is to provide a hinge that simplifies the operations of maintenance and/or replacement thereof.

Another object of the invention is to provide a hinge which allows a simple adjustment of the door to which it is connected.

These objects, as well as other which will appear clearer hereafter, are fulfilled by a hinge having one or more of the features herein disclosed, claimed and/or shown.

Advantageous embodiments of the invention are defined in accordance with the dependent claims.

BRIEF DESCRIPTION OF THE DRAWINGS

Further features and advantages of the invention will appear more evident upon reading the detailed description of some preferred, non-exclusive embodiments of a hinge 1, which is described as non-limiting examples with the help of the annexed drawings, in which.

DETAILED DESCRIPTION OF SOME PREFERRED EMBODIMENTS

Figure 1:
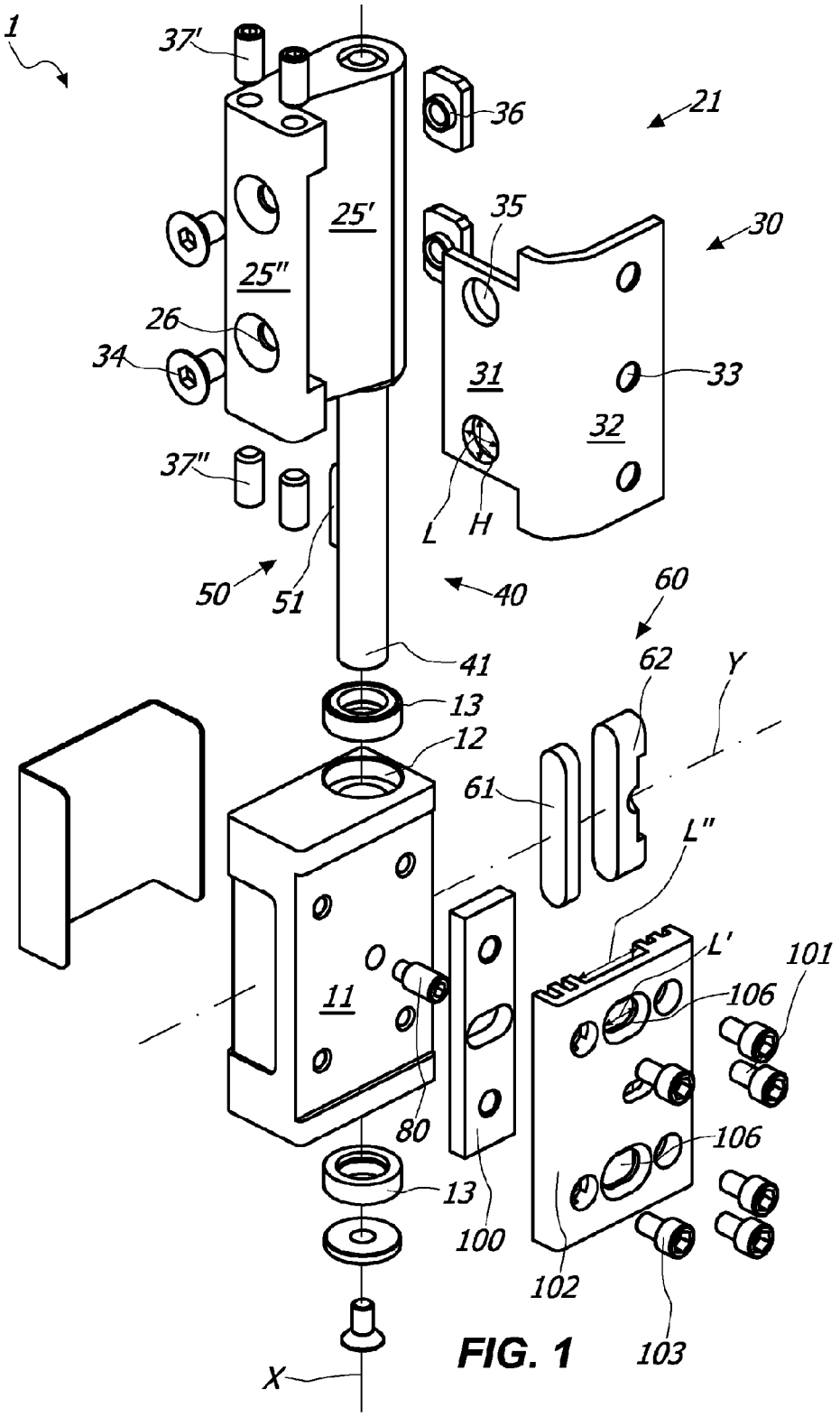
FIG. 1 is an exploded view of an embodiment of the hinge 1.

With reference to the above figures, the hinge according to the invention, generally indicated 1, is particularly useful for the rotatable possibly controlled movement during opening and/or closing of a closing element D, such as a reinforced door, which may be anchored to a stationary support structure, such as a wall, a floor or a ceiling.

Suitably, the hinge 1 may be concealedly inserted in a tubular support structure, which may be formed in a per se known manner by a rear counterframe CF, which can be anchored to the wall W or like support, and by a front frame F anchored to the counterframe CF.

In particular, the hinge 1 can be configured as a concealed "Anuba" hinge anchored to the frame F by the plate $P_2$.

Advantageously, the hinge 1 is concealedly insertable in the support structure formed by the tubular rear counterframe CF and the front frame F.

Conveniently, the hinge 1 may include a fixed element 10 to be fixed to the stationary support W, for example by the frame F or the counterframe CF, on which a movable element 20 is pivoted to rotate about a longitudinal axis X, which may be substantially vertical, between an open position and a closed position.

In particular, the hinge 1 may include, respectively may consist of, a lower fixed half-hinge 10 and a movable upper half-hinge 20 rotatably coupled each other to rotate between the open and closed positions about the axis X.

Advantageously, the lower fixed half-hinge 10 may include a box-shaped hinge body 11 anchored to the stationary support W, while the movable upper half-hinge 20 may include means 21 for fixing to the door D.

Figure 3A:
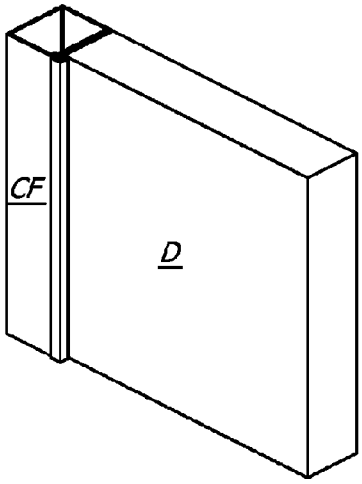
FIGS. 3*a* and 3*b* are respectively perspective and upper views of the embodiment of the hinge 1 of FIG. 1 in which the movable element 20 is mounted on a door D and the fixed element 10 is mounted on a frame F, the door D being in the closed position.
Figure 3B:
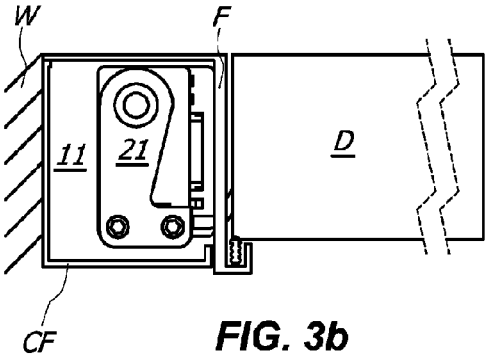
Figure 3C:
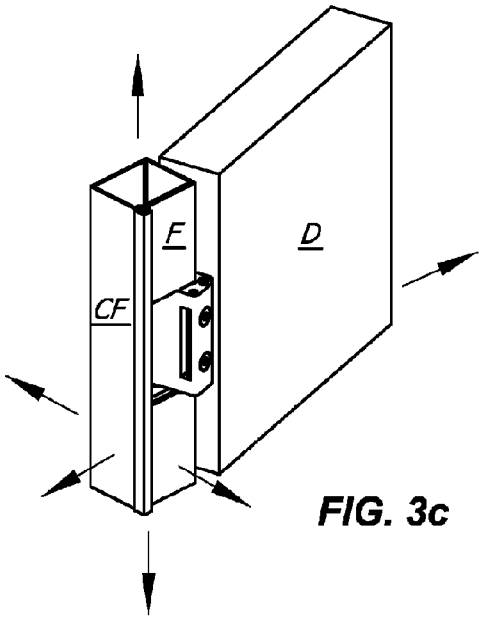
FIGS. 3*c* and 3*d* are respectively perspective and upper views of the embodiment of the hinge 1 of FIG. 1 in which the movable element 20 is mounted on a door D and the fixed element 10 is mounted on a frame F, the door D being in the open position.
Figure 3D:
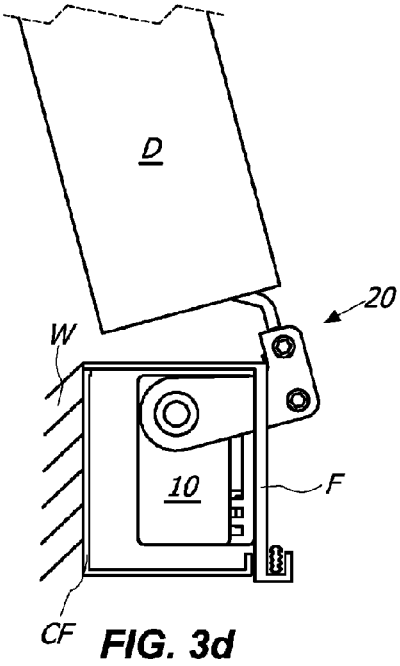

Suitably, the hinge body 11 may be concealedly insertable within the support structure formed by the tubular rear counterframe CF and the front frame F, while the connecting means 21 may be defined by a connecting plate susceptible to extend from the tubular support structure in the open position of the door D, as shown for example in FIGS. 3*c* and 3*d*, and to retract within the same tubular support structure in the closed position of the door D, as shown for example in FIGS. 3*a* and 3*b*.

In particular, the connecting plate 21 of the hinge 1 may be rotatably connected to the body 11 by means of the hinge pivot 40, which will be better described later.

Advantageously, the box-shaped hinge body 11 may include a passing-through seat 12 defining the axis X within which is inserted with minimal clearance the pivot 40, which may be unitary connected to the connecting plate 21.

In this way, the pivot 40 is unitary movable with the door D between the open and closed positions. Thanks to this feature, the hinge 1 is able to support even very heavy doors D without misalignments or changing of the behaviour.

Suitably, at the ends of the passing-through seat 12 of the box-shaped body 11 respective anti-friction elements 13 may be placed, such as bearings. This allows the movable element 20 to rotate about the axis X with minimum friction, so that the hinge 1 is able to support even very heavy doors D.

The hinge body 11 may internally include a working chamber 14 defining a second axis Y which is substantially perpendicular to the first axis X defined by the passing-through seat 12 for the pivot 40.

Suitably, the pivot 40 may include cam means 50 rotating around the axis X, while the working chamber 14 may include follower means 60 interacting with the former to slidably move along the axis Y between a first and a second end-stroke position, corresponding for example to the open and closed door D position.

The follower means 60 may include an elastic counteracting element susceptible to elastically oppose the pushing force imparted by the cam means. As non-limiting example, the elastic counteracting element may include, respectively may consist of, a spring, a nitrogen cylinder or a portion of polymeric material.

In a preferred but not exclusive embodiment of the hinge 1, the elastic counteracting element may consist of an elastomer body 61, which may be plate-shaped, disk-shaped or cylindrical-shaped.

Advantageously, the elastomer body 61 may be made of a polyurethane elastomer of the compact type, for example Vulkollan®. Suitably, the elastomer may have a Shore A hardness of 50 ShA to 95 ShA, preferably of 70 ShA to 90 ShA. More preferably, the elastomer body 61 may have a Shore A hardness of 80 ShA.

The use of the elastomer in place of the classic spring allows for a very high braking force, in a very small space. In fact, the stroke of the elastomer body 61 along the axis Y may be of some millimeters, for example 2-4 mm.

Moreover, the elastomer body 61 allows achievement of a braking effect of great efficiency in a purely mechanical hinge without the use of oil or like hydraulic damping means, for example during the opening.

In fact, upon the opening of the door D the elastic counteracting element 61 passes from the first to the second end-stroke position and remains in this position until the closing of the door by a user, so that the hinge 1 is a control hinge braked during opening.

Moreover, the follower means 60 may advantageously include an interface element 62 having a first end 63' which interacts with the elastic counteracting element 61 and a second end 63" interacts with the cam means 50.

Advantageously, the interface element 62 may have a substantially "C"-shape with a central elongated portion 64 defining a third longitudinal axis Z substantially parallel to the axis X and perpendicular to the axis Y and a pair of end transverse appendices 65', 65" substantially perpendicular to the axis X and parallel to the axis Y.

Both the elongated central portion 64 and the end transverse appendices 65', 65" may include respective operating surfaces 66, 67', 67" placed at the front end 63", the function of which is better explained later.

Moreover, the pivot 40 may suitably include the cam means 50, so that the latter rotate unitary with the former around the axis X. Advantageously, the cam means 50 may include one or more cam elements susceptible to interact with the follower means 60.

Figure 4:
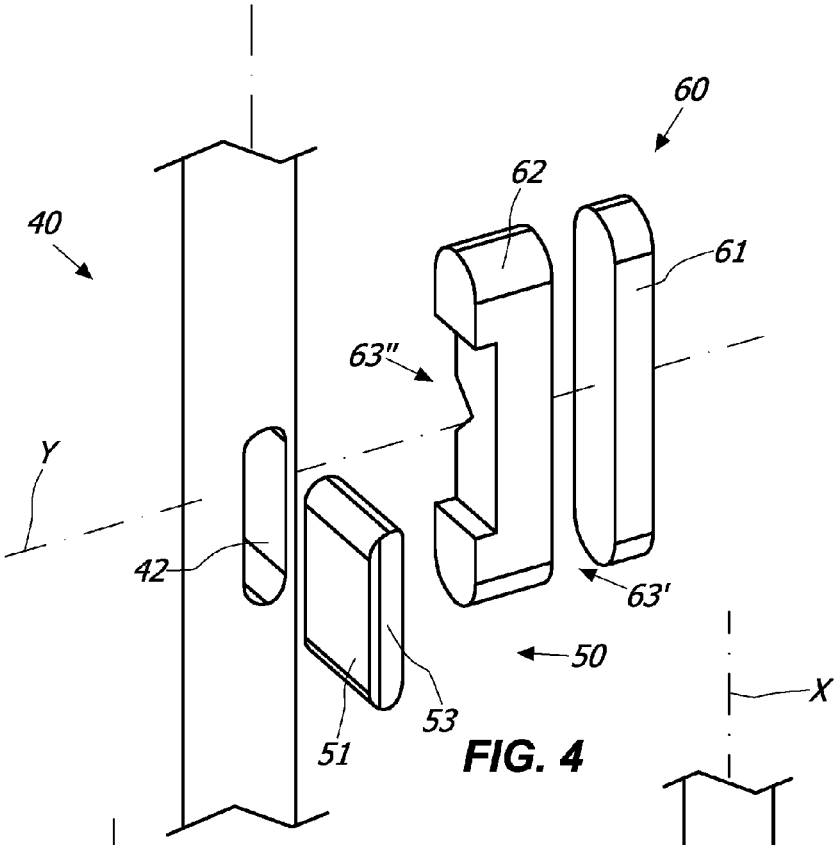
FIG. 4 is a schematic view of the assembly pivot 40 cam 51 interface element 62 elastic counteracting element 61 to be used in the embodiment of the hinge 1 of FIG. 1.
Figure 5:
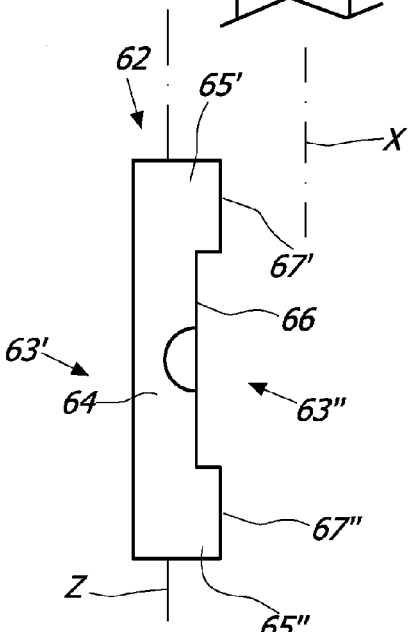
FIGS. 5 and 6 are respectively side views of a first embodiment of the interface element 62 and the pivot 40 to be used in the embodiment of the hinge 1 of FIG. 1.
Figure 6:
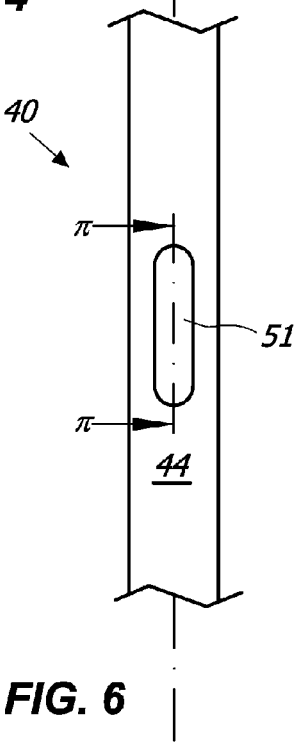
Figure 7A:
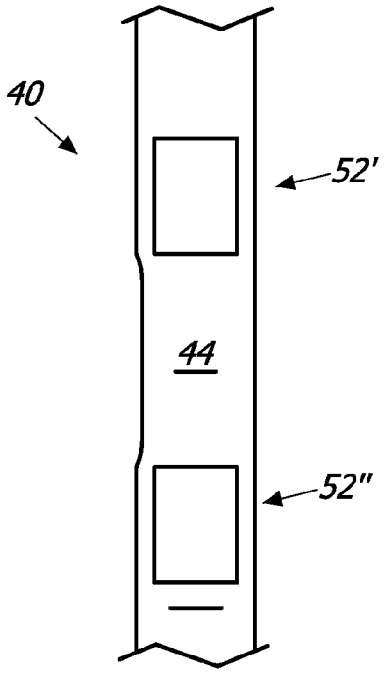
FIGS. 7*a* and 7*b* are side views of a second embodiment of the pivot 40 to be used in the embodiment of the hinge 1 of FIG. 1.
Figure 7B:
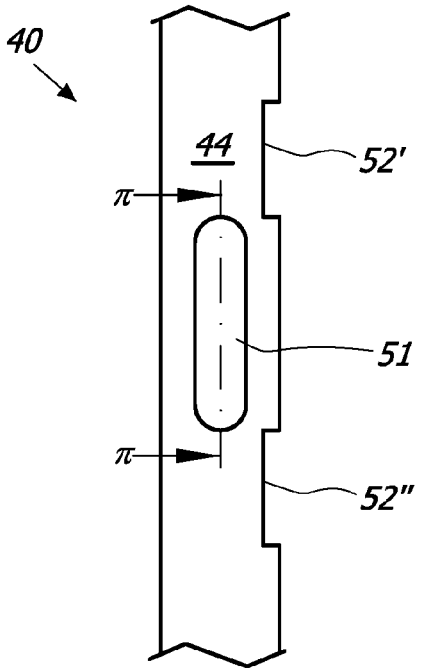
Figure 7C:
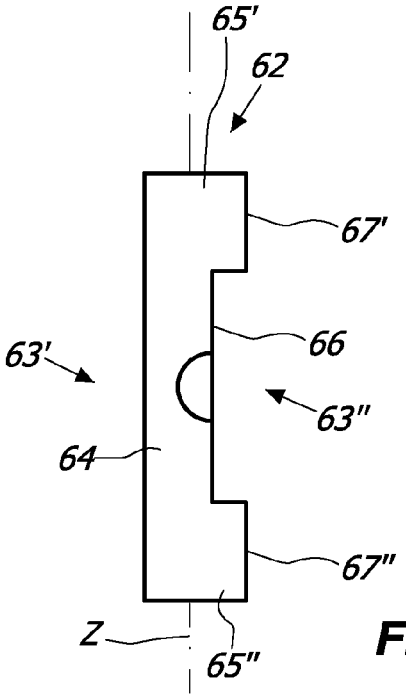
FIG. 7*c* is a side view of a second embodiment of the interface element 62 to be used in the embodiment of the hinge 1 of FIG. 1.
Figure 8B:
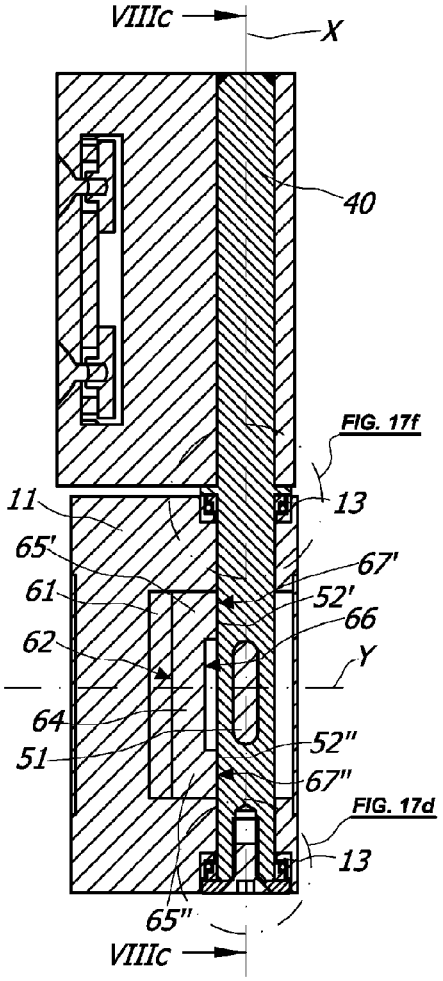
FIGS. 8*a*, 8*b* and 8*c* are respective top view and views sectioned along a plane VIIIb-VIIIb and along a plane VIIc-VIIc of the embodiment of the hinge 1 of FIG. 1, the hinge being in the closed position.
Figure 8C:
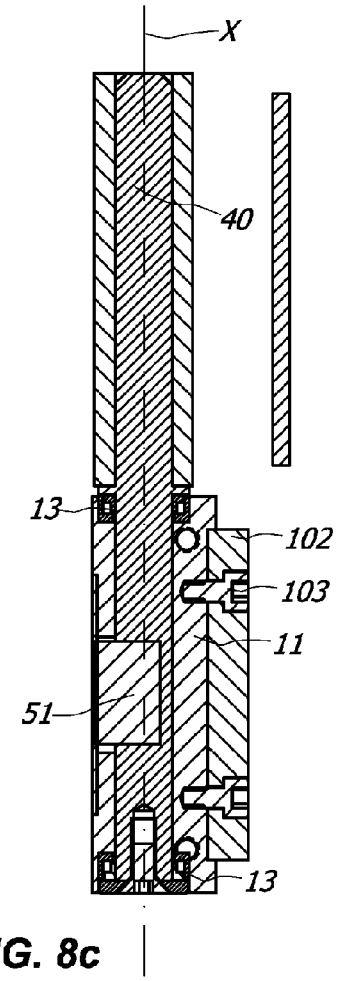
Figure 8A:
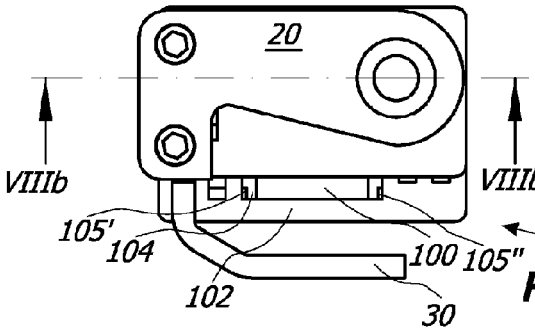
Figure 9A:
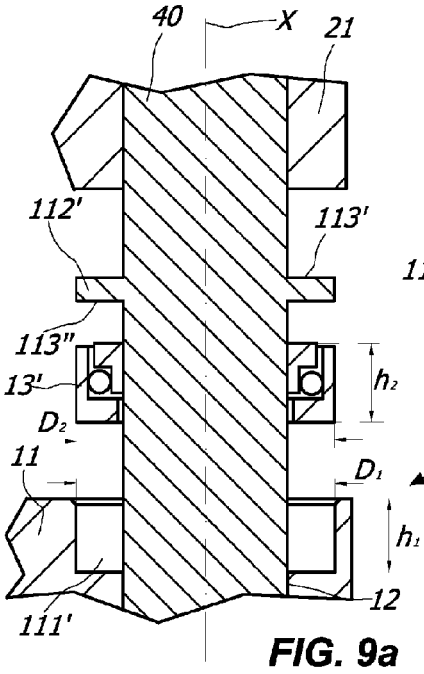
FIG. 9 is an enlarged view of some details of FIG. 8*b*, with in FIG. 9*a* an exploded view of such details.
Figure 9:
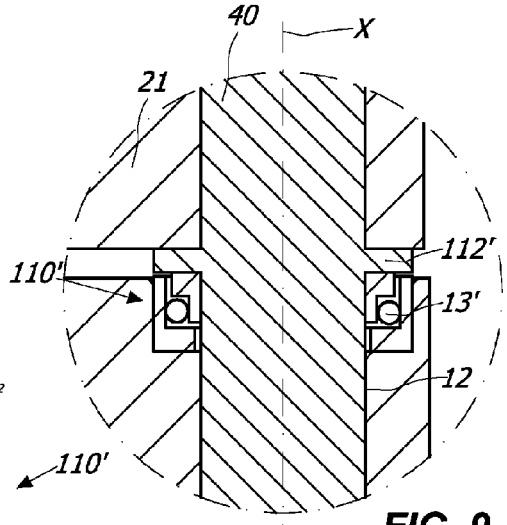
Figure 10:
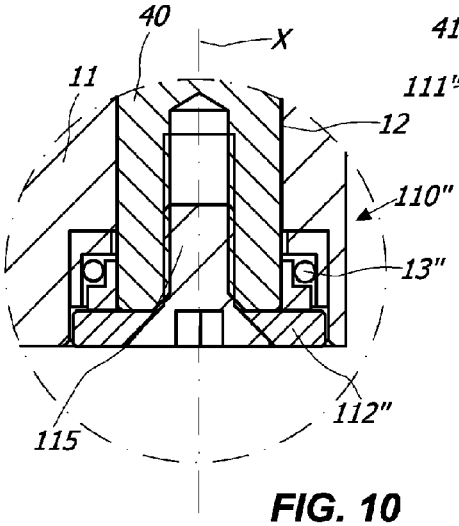
FIG. 10 is an enlarged view of further details of FIG. 8*b*, with in FIG. 10*a* an exploded view of such details.
Figure 10A:
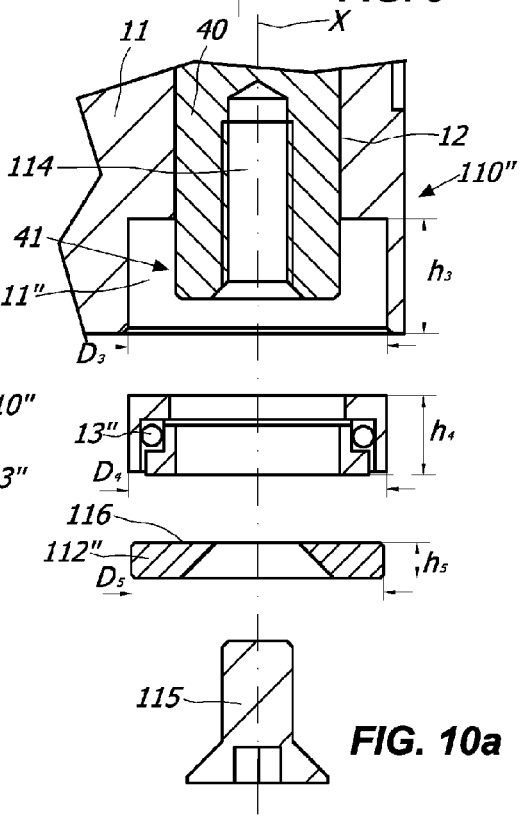

More particularly, in the pivot 40 of FIGS. 4 and 6 the cam means 50 may include a single cam element, while in the pivot 40 of FIGS. 7*a* and 7*b* the cam means 50 may include two cam elements.

For example, the single cam element may be defined by a plate-shaped body 51 insertable transversely in a removable manner within a seat 42 of the pivot 40 so that a portion of the former extends from the latter. This configuration simplifies the assembly of the hinge 1.

On the other hand, the plate-shaped body 51 may be integrated into the pivot 40 in an unremovable manner.

Suitably, the plate-shaped body 51 may have a front peripheral edge 53 susceptible to interact with the interface element 62, for example in correspondence of the operating surface 66. To this end, the front peripheral edge 53 may be appropriately rounded.

In this way, the interface element 62 progressively compresses the elastomer body 61 upon the opening of the door D. The elastomer body 61 may further be susceptible to remain in the configuration elastically deformed until the closing of the door D by a user. In other words, the hinge 1 is elastically braking upon opening.

Suitably the hinge 1 may be configured so that the cam element 51 interacts with the operating surface 66 after an angular rotation of the door D, for example 45°. Following interaction with the interface element 62, the cam element 51 compresses the elastomer body 61, so that the hinge is mechanically braked upon opening during the subsequent angular rotation, for example the next 45°. In other words, the first angular rotation is free, that is not braked, while the subsequent angular rotation is braked by the braking action of the elastomer body 61.

In one preferred but not exclusive embodiment, two cam elements may be provided, in particular a pair of first cam elements 52', 52" susceptible to interact with the operating surfaces 67', 67" of the interface element 62 and a second cam element consisting of the plate-shaped element 51 which is susceptible to interact with the operating surface 66.

The first cam elements 52', 52" may be defined by a pair of substantially flat faces formed on the outer surface 44 of the pivot 40, in longitudinally staggered positions so as to be operatively in contact with the operating planar surfaces 67', 67" of the interface element 62.

Conveniently, the cam means 50 and the follower means 60 may be configured so that the substantially flat faces 52', 52" and the operative surfaces 67', 67" are substantially parallel and in mutual contact when the door D is in the closed position, as shown for example in FIGS. 11*a* to 11*d*, and are substantially perpendicular and spaced apart each other when the door D is in the open position, as shown for example in FIGS. 13*a* to 13*d*.

The plate-shaped element 51 may further define a plane $\pi$ substantially perpendicular to the substantially planar faces 52', 52".

In this way, it is possible to achieve a full control on the door D upon the opening, throughout all the angular rotation thereof.

In fact, for a first portion of angular rotation the substantially flat faces 52', 52" and the operative surfaces 67', 67" interact with each other to partially compress the elastomeric body 61, thus urging it from the rest or starting stroke position to an intermediate compressed position. Further, for the next portion of the angular rotation of the door D the plate-shaped element 51 and the operating surface 66 of the interface element 62 interact each other so as to further compress the elastomeric body 61, thus compressing it from the intermediate compressed position to the totally compressed or end stroke position.

This allows to progressively compress the elastic element, so as to obtain a braking effect for the entire angular rotation of the door D.

In another preferred but not exclusive embodiment, shown for example in the FIGS. 13*a* to 19, the interface element 62 may be configured as a pushing member 68' and include a protrusion 300, having a generally hemispherical shape. On the other hand, the cam means 50 may include a plurality of seats 310, 320, 330 each corresponding to a supper position of the door.

More in particular, the seats 310, 320, 330 are able to receive the protrusion 300 to supper the door in the supper positions.

Suitably, the seat 310 may correspond to the closed door position, while the seats 320, 330 may correspond to the open door positions. Advantageously, the latter may be mutually opposite with respect to the closed door position.

In a preferred but not exclusive embodiment, the seat 310 corresponding to the closed door position may have a generally "V"-shape with two consecutive planes 311, 312 angled each other with predetermined angle.

Figure 15:
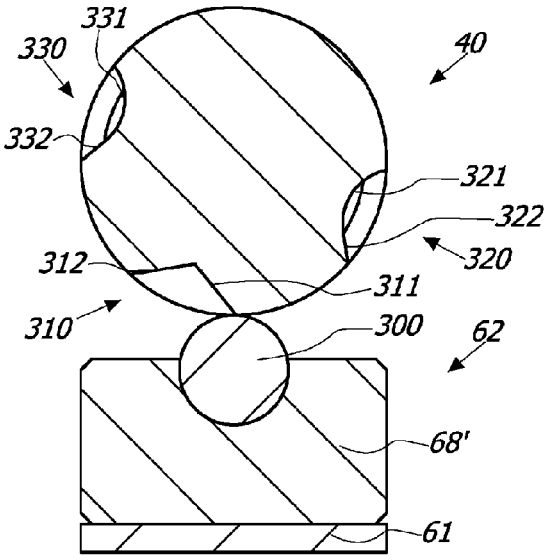

In this way, as particularly shown in FIG. 15, the sliding of the hemispherical protrusion 300 on the planes 311, 312 upon the rotation of the door is simplified, so as to ensure the automatic closing of the door starting from a predetermined angle, for example 20°.

At the same time, the user can rotate the door from the closed door position in both opening directions.

To maximize this effect, the angle between the planes 311, 312 may be at least 90°, preferably at least 110°. In a preferred but not exclusive embodiment, the angle between the planes 311, 312 may be 120°.

Moreover, each of the seats 320, 330 corresponding to the open door positions may advantageously have two consecutive portions 321, 322; 331, 332 having different shape.

The first portions 322; 332 may be generally flat, while the second portions 321; 331 may be countershaped with respect to the shape of the protrusion 300, and in particular may be hemispherical.

In this way, the first flat portions 322; 332 may promote the sliding of the projection 310 thereon to convey it towards the second portions 321; 331, suitable to supper the door.

Figure 16:
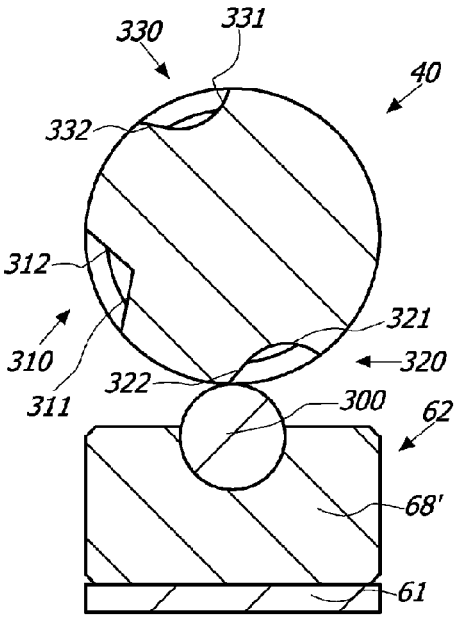

In this way, as particularly shown in FIG. 16, the automatic opening of the door starting from a predetermined angle, for example 70°, is ensured.

Figure 17:
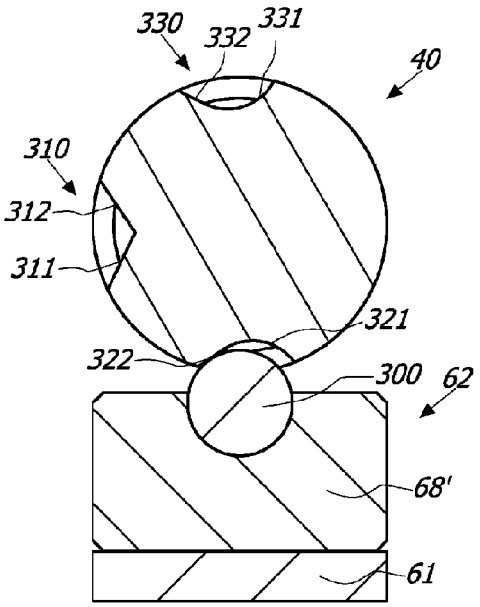
Figure 18:
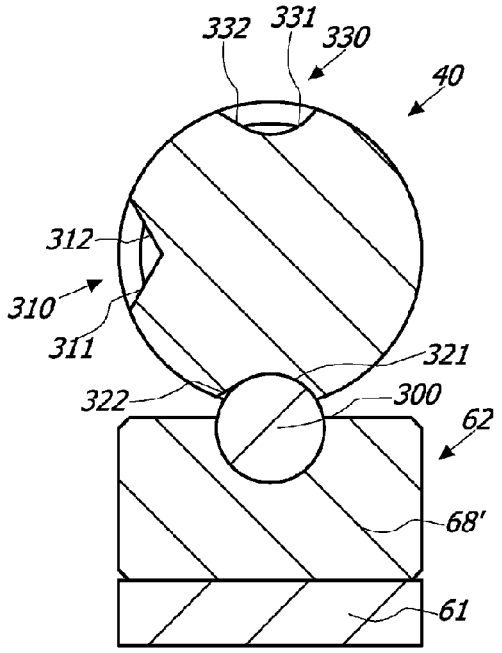

As particularly shown in FIG. 17, the first flat portions 322; 332 act as pilot members for the second hemispherical portions 321; 331, so that the insertion of the protrusion 300 in the latter takes place without noise.

Advantageously, the first flat portions 322; 332 may be substantially perpendicular to the planes 312, 311.

Moreover, thanks to the above configuration the door may be rotated from the supper position only in one direction. In other words, the rotation in the other direction is prevented.

Figure 19:
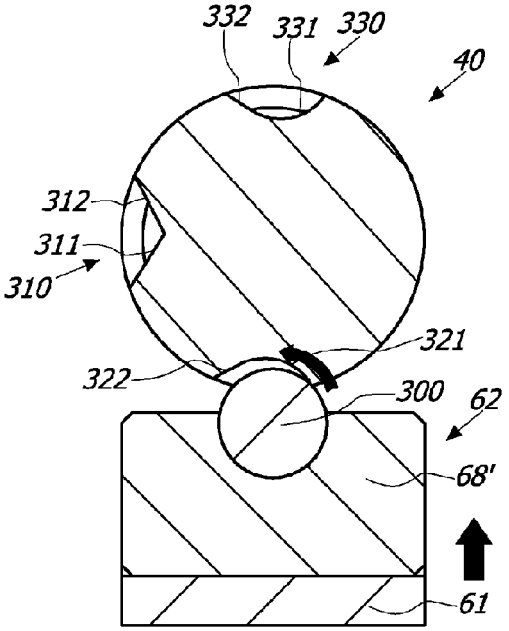

Indeed, as particularly shown in FIG. 19, if a user attempts to further rotate the door, the momentum caused by the elastic counteracting element 61 opposes this force, which momentum urges the one against the other the protrusion 300 and the second portions 321; 331.

Suitably, the elastic counteracting element 61 may be configured so as to allow a further slight rotation of the door after the supper position in the door open position. To this end, the elastic counteracting element 61 after this minimum rotation can reach the position of maximum compression.

This absorbs the shock undergone by the door upon the reaching of the supper position. This configuration is particularly advantageous in the case of glass door, which in the case of abrupt shock could be damaged or broken.

The embodiment of the cam means 50 and the follower means 60 shown in FIGS. 13*a* to 19 and described above is particularly advantageous with the above described elastic counteracting element 61 made of elastomer.

In fact, in the latter a minimum stroke corresponds to a very high strength.

Therefore, suitably precompressing the elastic counteracting element 61 in the working chamber 14 the strength of the hinge 1 is maximized.

Also, the elastic counteracting element 61 made of elastomer maximizes the effect of stopping the rotation, as described above.

In one preferred but not exclusive embodiment, it is possible to adjust the opening angle of the door D.

For the purpose, an adjusting screw 80 may be provided transversely inserted in the hinge body 11 with a first operating end 81 accessible by a user to adjust the penetration of the former 80 through the corresponding wall of the latter 11 and an opposite end 82 susceptible to come into contact with the plate-shaped element 51.

By appropriately acting on the operating end 81 of the screw 80 the opening angle of the door can be adjusted in a simple and rapid manner, so as to avoid any impact of the door D against the stationary support W.

The hinge 1 is extremely effective and performing, and is also greatly simple to assemble.

For example, the hinge body 11 may have, in addition to the passing-through seat 12 for containing the pivot 40, a passing-through opening 16 to make accessible the working chamber 14 from the outside.

In particular, the passing-through opening 16 may be susceptible to allow the insertion within the working chamber 14 of both the follower means 60 and the cam means 50, in particular of the plate-shaped element 51.

The passing-through opening 16 defines an axis Y' perpendicular to both the axis Y and the axis X.

In practice, both the cam means 50 and the follower means 60 may be removably inserted in the working chamber 14 by sliding along the axis Y'.

This is particularly advantageous if it is necessary to change the elastic element 61, for example to insert a softer or harder one in order to vary the braking action of the hinge 1, or to change the plate-shaped element 51, for example to insert one of different configuration to vary the braking action of the hinge 1.

In fact, in order to mount the cam means 50 and the follower means 60, it is simply needed to insert within the working chamber 14 through the passing-through opening 16 the elastic counteracting element 61 and the interface element 62, subsequently to insert the pivot 40 into the seat 12 and then rotate the latter to move the seat 42 thereof in correspondence of the same passing-through opening 16, so as to allow the insertion of the plate-shaped element 51. The dismounting thereof may occur in the reverse order.

The hinge 1, in addition to the above mentioned features and advantages, is particularly advantageous because it is possible to adjust the position of the door D in the three dimensions, that is both in height and in a plane substantially parallel to the floor as shown for example in FIG. 3*c*.

Figure 2A:
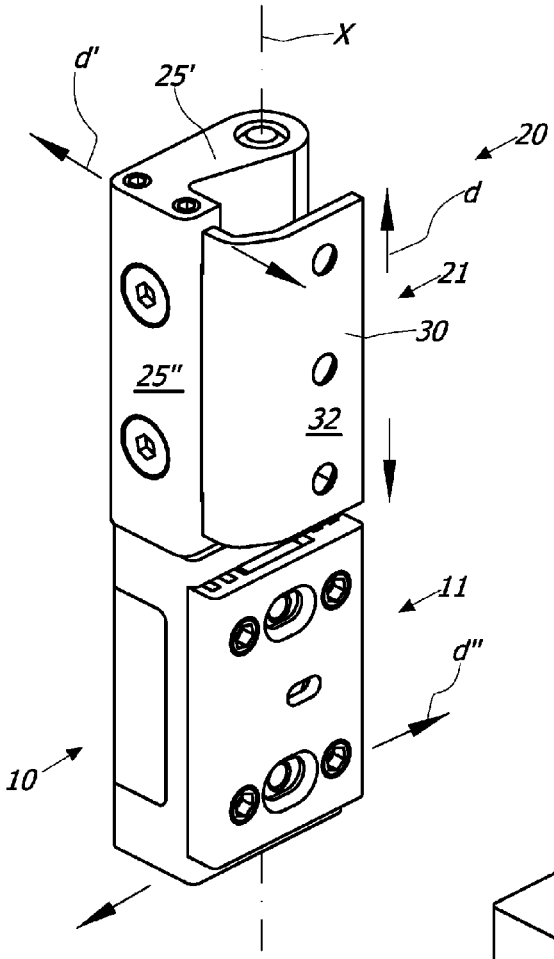
FIGS. 2*a* and 2*b* are perspective views of the embodiment of the hinge 1 of FIG. 1 respectively in the closed and open position.
Figure 2B:
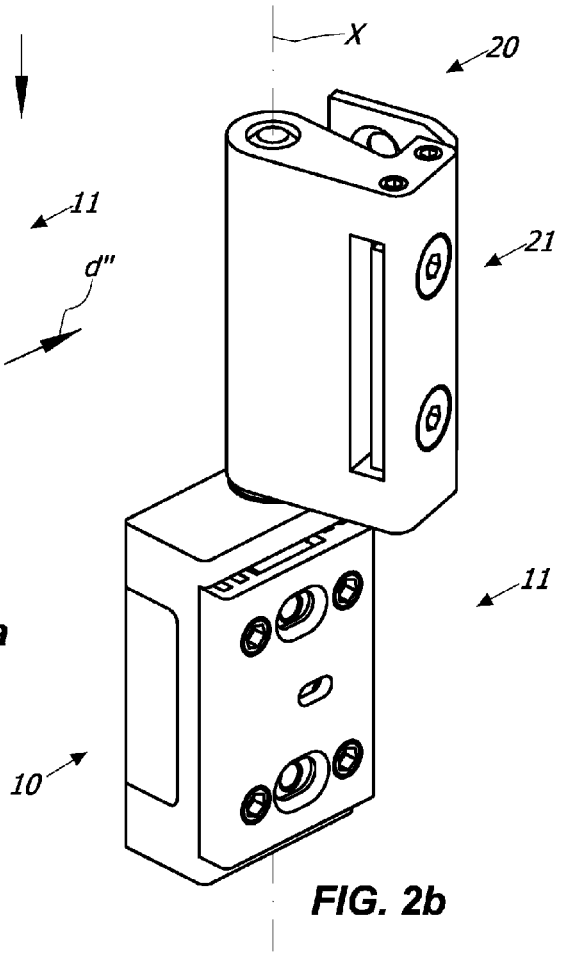

In fact, the connecting plate 21 may include a first portion 25' susceptible to receive the pivot 40 and a second portion 25" susceptible to receive the mounting bracket 30 and to allow the adjustment along the directions d, d', as shown in FIG. 2*b*.

Suitably, the mounting bracket 30 may have a first plate portion 31 operatively fixable to the first portion 25' of the mounting body 24 monolithically coupled with a second plate portion 32, connectable in turn to the door D by means of suitable screws insertable into the holes 33.

The operational connection between the first portion 25' of the mounting body 24 and the first plate portion 31 of the mounting bracket 30 may be made by means of suitable screws 34 inserted through the holes 26 of the mounting body 24 and the openings 35 of the mounting bracket 30 and lockable in suitable locking elements 36.

By suitably operating on the screws 34 it is possible to move the mounting bracket 30, and then the door D, along the direction d'. In fact, by appropriately unscrewing the screws 34 it is possible to move the mounting bracket 30 for a stroke equal to the length L of the openings 35 in which the screws 34 are inserted.

The movement along the vertical direction d is ensured by the screws 37', 37" inserted through the second portion 25" of the connecting plate 21, the first plate portion 31 of the mounting bracket 30 lying therebetween. As mentioned above, the latter is secured to the former by using the screws 34.

The screws 37', 37" can be operated by unscrewing the screws 34, that allow the movement of the mounting bracket 30 with a stroke equal to the height H of the openings 35 in which the screws 34 are inserted.

To enable movement of the hinge 1 along the direction d", the hinge body 11 may be movably mounted on an anchor plate 100, which may be anchored to the tubular support structure F, CF by using the screws 101.

To this end, a backplate 102 may be provided, which may be coupled to the hinge body 11 by means of screws 103 to define an interspace 104 therebetween, in which interspace the anchor plate 100 is housed. The interspace 104 may include two side abutment surfaces 105', 105".

Figures 11, 12:
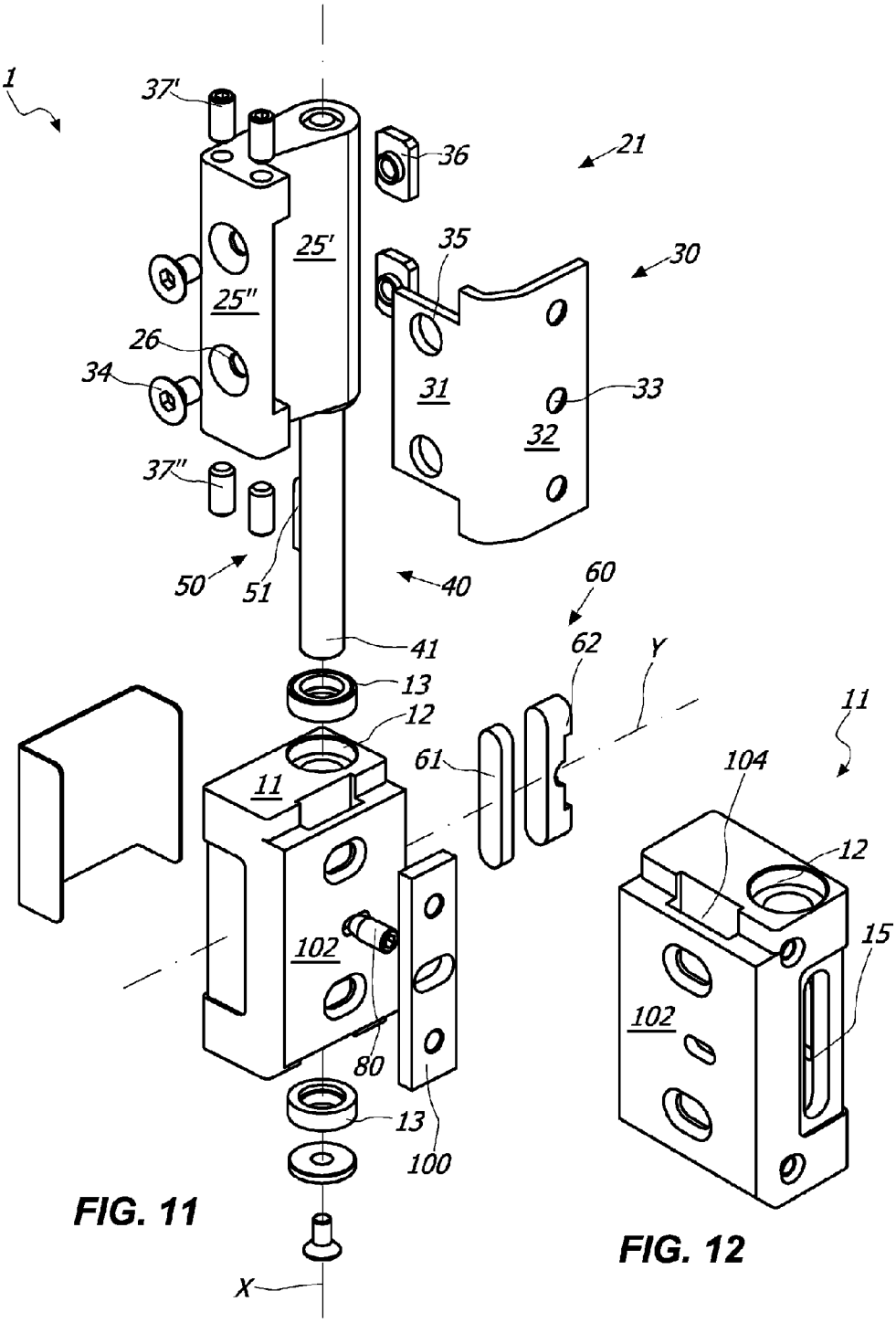
FIG. 11 is an exploded perspective view of a further embodiment of the hinge 1, in which the box-shaped hinge body 11 is integral with the backplate 102.
FIG. 12 is a perspective view of the hinge body 11 of the embodiment of the hinge 1 of FIG. 11.
Figure 13A:
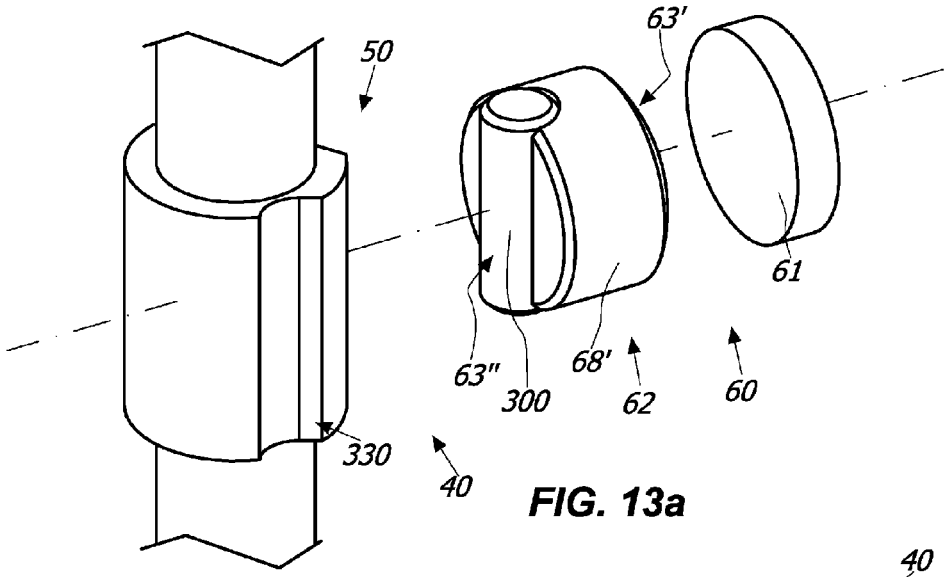
FIGS. 13*a* and 13*b* are respectively perspective and sectional partly cut views of some details of a further embodiment of the cam means 50 and the follower means 60.
Figure 13B:
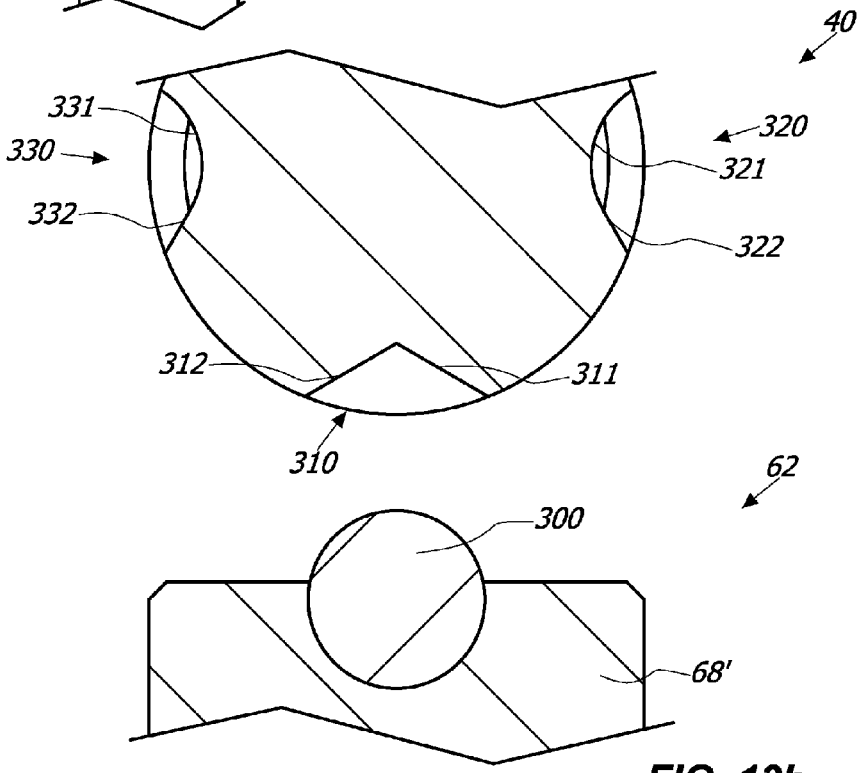
Figure 14:
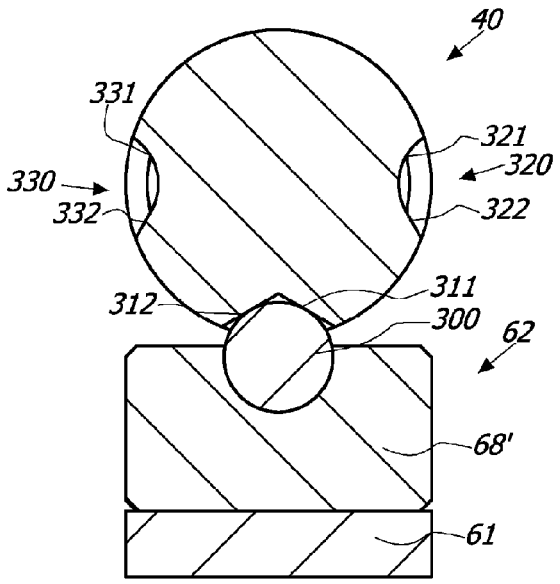
FIGS. 14 to 19 are sectional views of the cam means 50 and follower means 60 of FIGS. 13*a* and 13*b* in various operational steps, in which for each step the relative position of the cam means 50, the pushing member 68' and the elastic counteracting element 61 is enlargedly shown.

In the alternative embodiment shown in FIGS. 11 and 12, the backplate 102 may be integrated into the hinge body 11, i.e. the two parts can be made in a single piece. This allows to provide a more economic hinge 1.

The screws 101 are engageable in the anchor plate 100 by passing through the slots 106 of the backplate 102.

By appropriately acting on the screws 101 it is possible to move the assembly of the hinge body 11 and the backplate 102, and then the door D, along the direction d". In fact, by suitably unscrewing the screws 101, it is possible to move the assembly between the hinge body 11 and the backplate 102, and hence the hinge 1, for a stroke equal to the length L' of the slots 106 in which the screws 101 are inserted and/or the distance between the side abutment surfaces 105', 105" of the interspace 104.

The hinge 1 may further be designed to minimize friction between the fixed half-hinge 10 and the movable half-hinge 20.

For this purpose, the upper end 110' of the seat 12 may include a respective upper annular housing 111' suitable to receive a respective upper antifriction element 13', such as a bearing.

As particularly shown in FIGS. 17*d* and 17*e*, the pivot 40 may include a upper radial expansion 112', for example a flange, with an upper operating surface 113' susceptible to come in contact with the connecting plate 21 and a lower operating surface 113" susceptible to remain faced to the upper annular housing 111'.

Advantageously, the upper annular housing 111' and the upper antifriction element 13' may be mutually configured so that the lower operating surface 113" of the upper radial expansion 112' is susceptible to abut against the upper antifriction element 13'. In this way, the pivot 40 can rotate onto the upper antifriction element 13' by remaining mutually spaced from the hinge body 11.

To this end, the inner diameter $D_1$ of the upper annular housing 111' may be substantially equal to the outer diameter $D_2$ of the upper antifriction element 13', while the height $h_2$ of the latter may be slightly greater than the height $h_1$ of the former, for example a few tenths of a millimeter.

Furtherly, the lower end 110" of the seat 12 suitably includes a lower annular housing 111" susceptible to receive a respective lower antifriction element 13".

The lower end 41 of the pivot 40 may include a blind axial hole 114 susceptible to receive a locking screw 115. A pressure element 112" may further be provided, for example a washer, susceptible to be interposed between the locking screw 115 and the lower antifriction element 13" to define a lower radial expansion. Advantageously, the latter may include an upper operative surface 116 susceptible to remain faced to the lower annular housing 111".

The latter, the lower antifriction element 13" and the pivot 40 may be mutually configured so that the upper operative surface 116 of the pressure element 112" is susceptible to abut against the pivot 40 and to remain spaced apart from the lower antifriction element 13".

In this way, the possible reaction force due to the rotation of the pivot 40 at its lower end 41 is loaded on the lower antifriction element 13".

This prevents the slipping of the pivot 40 from the seat 12 and/or the misalignment of the same pivot 40.

To minimize friction between the lower fixed half-hinge 10 and the upper half-hinge 20, the inner diameter $D_3$ of the lower annular housing 111" may be substantially equal to the outer diameter $D_4$ of the lower antifriction element 13", while the outer diameter $D_5$ of the pressure element 112" may be slightly less than the inner diameter $D_3$ of the lower annular housing 111".

Moreover, the height $h_3$ of the latter may suitably be substantially equal to the sum of the height $h_4$ of the lower antifriction element 13" and the height $h_5$ of the pressure element 112".

Advantageously, the upper and lower antifriction elements 13', 13" may consist of bearings of the axial-radial type, in order to suitably load thereon both the axial and the radial stresses due to the weight of the door D and/or their reactions forces.

From the above description, it is apparent that the hinge 1 fulfils the intended objects.

The hinge 1 is susceptible to many changes and variants. All particulars may be replaced by other technically equivalent elements, and the materials may be different according to the needs, without exceeding the scope of the invention defined by the appended claims.

The invention claimed is:

1. A concealed hinge for coupling a door and a tubular support structure, the tubular support structure including a rear counterframe and a front frame mutually coupled to each other, the hinge comprising:

a lower fixed half-hinge;

an upper movable half-hinge, the lower fixed half-hinge and the upper movable half-hinge being rotatably coupled each other for rotating about a first longitudinal axis between an open position and a closed position;

wherein said lower fixed half-hinge includes a box-shaped hinge body to be concealedly anchored within the tubular support structure, said upper movable half-hinge including a pivot defining said first axis and a connecting plate to be anchored to the door, the connecting plate being reciprocally connected with said pivot to extend from the tubular support structure in said open position and to concealedly retract within the tubular support structure in said closed position;

wherein said box-shaped hinge body includes a pivot seat for housing said pivot, the pivot including a cam member protruding therefrom, said box-shaped hinge body further including at least one working chamber including a follower member interacting with said cam member for sliding along a second longitudinal axis between a first and a second end-stroke position, the second longitudinal axis being perpendicular to said first axis, said follower member including at least one elastic counteracting element;

wherein said pivot includes a cam seat, the cam member being removably insertable into said cam seat, said box-shaped hinge body including at least one passing-through opening to allow insertion or removal of said cam member in or from said cam seat when the pivot is mounted into the pivot seat.

2. The hinge according to claim 1, wherein said cam member includes at least one elongated appendix transversely extending with respect to said first axis to rotate about said first axis, said follower member including at least one interface element having a first end interacting with said at least one elastic counteracting element and a second end interacting with said at least one elongated appendix.

3. The hinge according to claim 2, wherein said elongate appendix defines a plane parallel to said first axis and perpendicular to said second axis.

4. The hinge according to claim 3, wherein said elongate appendix is defined by a plate-shaped element.

5. The hinge according to claim 1, wherein said passing-through opening allows the insertion or removal of both said cam member in or from said seat and the follower member in or from the working chamber.

6. The hinge according to claim 5, wherein said seat of said pivot, said working chamber and said at least one passing-through opening are reciprocally configured in such a manner that the mounting of said cam member and said follower member occurs by at first inserting said follower member within said working chamber through said passing-through opening, subsequently by inserting the pivot into said pivot seat and then by rotating the latter to move the cam seat in correspondence of said passing-through opening, so as to allow a user to insert said cam member.

7. The hinge according to claim 1, wherein said box-shaped hinge body further comprises at least one abutment screw having a first operating end lying within said seat for abutting against said cam member and a second operating end accessible from outside by a user to adjust the penetration of said at least one abutment screw within said seat, so as to adjust the opening and/or closing angle of the hinge.

8. The hinge according to claim 7, wherein said at least one abutment screw is transversely inserted within the hinge body with respect to said first axis, said cam member including at least one side wall configured to impact against said first operating end of said at least one abutment screw.

9. The hinge according to claim 1, wherein said at least one elastic counteracting element includes an elastomer body.

10. The hinge according to claim 9, wherein said elastomer body is compact polyurethane.

11. The hinge according to claim 10, wherein said elastomer body has a Shore A hardness of 50 ShA to 95 ShA.

12. The hinge according to claim 1, wherein said seat is defined by a hole passing-through said hinge body, the upper end of said seat including a respective upper annular housing configured to house a respective upper antifriction element, the lower end of said seat including a respective lower annular housing configured to house a respective lower antifriction element, said movable half-hinge being rotatably pivoted on said hinge body to rotate onto said upper antifriction element or said lower antifriction element, said pivot including a lower radially enlarged member configured to abut against said lower antifriction element to prevent the slipping of the pivot from said seat or to prevent the misalignment of said pivot during use.

13. The hinge according to claim 12, wherein said pivot includes an upper radially enlarged member with an upper operating surface configured to abut against said connecting plate and a lower operating surface configured to remain faced to the upper annular housing, said upper annular housing and upper antifriction element being mutually configured so that the lower operating surface of said upper radially enlarged member is configured to abut against said upper antifriction element, in such a manner that said pivot rotates onto said upper antifriction element remaining mutually spaced apart from said hinge body.

14. The hinge according to claim 13, wherein said upper annular housing has a predetermined first inner diameter and first height, said upper antifriction element having a generally annular shape with a predetermined second outer diameter and second height, said first inner diameter being equal to said second outer diameter, said predetermined second height being slightly higher than said predetermined first height to minimize friction between said fixed lower half-hinge and said upper half-hinge.

15. The hinge according to claim 14, wherein said lower radially enlarged member comprises an upper operating surface configured to remain facing the lower annular housing, said lower annular housing, pivot and lower antifriction element being mutually configured so that the upper operating surface of said lower radially enlarged member is directly engaged with said pivot.

16. The hinge according to claim 15, wherein the lower end of said pivot includes an axial blind hole adapted to receive a locking screw, a pressure member interposed between said locking screw and said lower antifriction element being provided to define said lower radially enlarged member, and further wherein said locking screw, said pressure member, said axial blind hole, said lower antifriction element and said lower annular housing are configured to pull the pivot and to urge said lower operating surface of said upper radially enlarged member against said upper antifriction element and said upper operating surface of said lower radially enlarged member against said lower antifriction element.

17. The hinge according to claim 16, wherein said lower annular housing has a predetermined third inner diameter and third height, said lower antifriction element having a generally annular shape with a predetermined fourth outer diameter and fourth height, said pressure member having a generally annular shape with a predetermined fifth outer diameter and fifth height, said third inner diameter being equal to said fourth outer diameter, said fifth outer diameter being slightly less than said third inner diameter to minimize friction between said fixed lower half-hinge and said upper movable half-hinge.

18. A concealed hinge for coupling a door and a tubular support structure, the tubular support structure including a rear counterframe and a front frame mutually coupled to each other, the hinge comprising:

a lower fixed half-hinge;

an upper movable half-hinge, the lower fixed half-hinge and the upper movable half-hinge being rotatably coupled each other for rotating about a first longitudinal axis between an open position and a closed position;

wherein said lower fixed half-hinge includes a box-shaped hinge body to be concealedly anchored within the tubular support structure, said upper movable half-hinge including a pivot defining said first axis and a connecting plate to be anchored to the door, the connecting plate being reciprocally connected with said pivot to extend from the tubular support structure in said open position and to concealedly retract within the tubular support structure in said closed position;

wherein said box-shaped hinge body includes a pivot seat for housing said pivot, the pivot including a cam member protruding therefrom, said box-shaped hinge body further including at least one working chamber including a follower member interacting with said cam member for sliding along a second longitudinal axis between a first and a second end-stroke position, the second longitudinal axis being perpendicular to said first axis, said follower member including at least one elastic counteracting element;

wherein said pivot includes a cam seat, the cam member including a plate-shaped element removably insertable into said cam seat, said box-shaped hinge body including at least one passing-through opening to allow insertion or removal of said plate-shaped element in or from said cam seat when the pivot is mounted into the pivot seat.

* * * * *